US006902265B2

(12) United States Patent
Critelli et al.

(10) Patent No.: US 6,902,265 B2
(45) Date of Patent: Jun. 7, 2005

(54) METHOD FOR PRINTING HIGH INFORMATION DENSITY MACHINE-READABLE COMPOSITE IMAGES

(75) Inventors: Michael J. Critelli, Darien, CT (US); Judith D. Auslander, Westport, CT (US); Perry A. Pierce, Darien, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/413,096

(22) Filed: Apr. 14, 2003

(65) Prior Publication Data

US 2004/0001133 A1 Jan. 1, 2004

Related U.S. Application Data

(60) Provisional application No. 60/392,996, filed on Jun. 28, 2002.

(51) Int. Cl.[7] ..... B41J 2/01

(52) U.S. Cl. ..... 347/101; 347/98; 235/487

(58) Field of Search ..... 347/101, 100, 347/95, 96, 98; 235/491, 487, 468; 250/271; 705/1

(56) References Cited

U.S. PATENT DOCUMENTS

| | | | | |
|---|---|---|---|---|
| 5,502,304 A | * | 3/1996 | Berson et al. | 250/271 |
| 5,514,860 A | | 5/1996 | Berson | |
| 5,525,798 A | | 6/1996 | Berson et al. | |
| 5,542,971 A | | 8/1996 | Auslander et al. | |
| 5,684,069 A | | 11/1997 | Auslander | |
| 5,693,693 A | | 12/1997 | Auslander et al. | |
| 5,871,288 A | | 2/1999 | Ryan, Jr. et al. | |
| 6,039,257 A | | 3/2000 | Berson et al. | |
| 6,106,110 A | * | 8/2000 | Gundjian et al. | 347/98 |
| 6,132,024 A | | 10/2000 | Nelson et al. | |
| 6,142,380 A | * | 11/2000 | Sansone et al. | 235/487 |
| 6,149,719 A | | 11/2000 | Houle | |
| 6,164,749 A | | 12/2000 | Williams | |
| 6,199,765 B1 | | 3/2001 | Uhling | |
| 6,234,694 B1 | | 5/2001 | Brookner | |
| 6,415,983 B1 | | 7/2002 | Ulvr et al. | |
| 6,651,894 B2 | * | 11/2003 | Nimura et al. | 235/494 |
| 2003/0167179 A1 | * | 9/2003 | Briley | 705/1 |

OTHER PUBLICATIONS

Information–Based Indicia Program (IBIP). Performance Criteria for Information–Based Indicia and Security Architecture for Close IBI Postage Metering Systems (PCIBI–C). United States Postal Service (USPS) Jan. 12, 1999.

Information–Based Indicia Program (IBIP). Performance Criteria for Information–Based Indicia and Security Architecture For Open IBI Postage Evidencing Systems (PCI-BI–O). United States Postal Service (USPS) Feb. 23, 2000.

Performance Criteria for Information–Based Indicia Program (IBIP) System Employing Centralized Postal Security Devices. United States Postal Service Aug. 17, 2000.

* cited by examiner

*Primary Examiner*—Manish Shah
(74) *Attorney, Agent, or Firm*—Charles R. Malandra, Jr.; Angelo N. Chaclas

(57) ABSTRACT

Machine-readable light-colored or invisible, but luminescent, postage-evidencing symbology and dark, readable other postage information are printed, preferably in a single print operation, to provide large amounts of information without diminishing read rates. The resulting combination image can be printed independent of substrate material to enable the provision of a high information density without obscuring any one component. The postage-evidencing symbology is printed in large-format and can include redundant information within an IBI image or between an IBI and visible dark image for a variety of practical purposes. In a preferred form, the images are printed using conventional ink jet printers using water-based inks. In one embodiment of this type, the images are printed with a conventional two-cartridge color ink jet printer by printing postage-evidencing symbology with a single-color ink and printing the visible dark image as a composite dark color from a standard multi-color cartridge.

20 Claims, 7 Drawing Sheets

METHOD FOR PRINTING HIGH INFORMATION DENSITY MACHINE-READABLE COMPOSITE IMAGES

CROSS REFERENCE TO RELATED APPLICATIONS

This application claims priority under 35 U.S.C. section 119(e) from Provisional Patent Application Ser. No. 60/392,996, filed Jun. 28, 2002, entitled SYSTEM FOR PRINTING HIGH INFORMATION DENSITY MACHINE-READABLE COMPOSITE IMAGES, which is incorporated herein by reference in its entirety.

BACKGROUND OF THE INVENTION

The invention relates to printing composite images that can contain large amounts of information, optionally including redundant information, in an eye-pleasing format. The composite image provides high information density in a highly reliable and visually pleasing form and has significant security features. The composite images are achieved with a novel arrangement of largely invisible, machine-readable postage evidencing information, e.g., Information Based Indicia (IBI) images containing 2-D bar code information, and dark, visible images containing human-readable postage information, which typically includes address information. The images can be printed using conventional ink jet printers.

Postage evidencing information, including IBI images, is a significant feature of the Information-Based Indicia Program (IBIP) implemented by the United States Postal Service (USPS) as a distributed trusted system. The IBIP includes open IBI postage evidencing systems, which can apply postage in addition to performing other functions not possible with conventional postage machines. The IBIP requires printing high density, two-dimensional (2-D) bar codes, such as PDF417 bar codes, on mailpieces. The requirements for printing a PDF417 2-D bar code are set forth in The Uniform Symbology Specification. The Postal Service expects the IBIP to provide cost-effective assurance of postage payment for each mailpiece processed. IBI images comprise certain human readable information and two-dimensional (2-D) bar code information, which can contain such assurance. However, printed information is often obscured, diminishing its reliability even with error correction technology. There is a need for a high-density image format that includes both human readable and bar code information with high reliability.

The USPS has published specifications for the IBIP such as PERFORMANCE CRITERIA FOR INFORMATION-BASED INDICIA AND SECURITY ARCHITECTURE FOR OPEN IBI POSTAGE EVIDENCING SYSTEMS (PCIBI-O), dated Jan. 12, 1999; PERFORMANCE CRITERIA FOR INFORMATION-BASED INDICIA AND SECURITY ARCHITECTURE FOR CLOSED IBI POSTAGE METERING SYSTEMS (PCIBI-C), dated Feb. 23, 2000; and PERFORMANCE CRITERIA FOR INFORMATION-BASED INDICIA PROGRAM (IBIP) SYSTEMS EMPLOYING CENTRALIZED POSTAL SECURITY DEVICES, dated Aug. 17, 2000; (collectively referred to herein as the "IBIP Specifications"). The IBIP includes interfacing user (customer), postal and vendor infrastructures, which are the system elements of the program. The term "postage evidencing information" is meant to include IBI images meeting the current IBIP Specifications as well as alternative formats.

A user infrastructure, which typically resides at the user's site, can comprise a postage security device (PSD) coupled to a host system. The PSD is a secure processor-based accounting device that dispenses and accounts for postal value stored therein. The host system (Host) may be a personal computer (PC) or a meter-based host processor. Alternatively, the PSD can be located on a server remote from the user. Wherever the PSD is located, it would be desirable for IBIP indicium to be printed using an open system comprised of conventional desk-top and other ink jet printers not dedicated to postage, but this capability has not been fully realized without sacrificing readability or the visual appearance of the printed mailpiece.

The IBIP Specifications require a minimum bar code read rate of 99.5% and place the responsibility on each IBIP vendor to meet this requirement. One of the issues raised is the readability of 2-D bar codes printed on envelopes. Different printing technologies work well with different types of paper. One particularly bad combination is ink jet printing on porous paper, such as recycled paper. The ink spots tend to feather, reducing the resolution and quality of the print. Thus, there is concern over the quality of postage evidencing symbology, such as 2-D bar codes, printed by ink-jet printers. Because the 2-D bar code comprises a lot of information, the quality of the print has a direct effect on the readability of the bar code. Furthermore, the print quality is affected by various printer characteristics that may be specific to each individual printer. In particular, since PC meter printers are open and not dedicated to printing postage indicia, they are not expected to meet any USPS requirements, such as the minimum read rate set forth in the IBIP Indicium Specification. A number of other factors, such as environmental conditions, type of ink and printer wear, can also affect print quality. Thus, the readability of the 2-D bar code will be affected by the various conditions outside the control of an IBIP vendor.

Adding another level of complexity, current United States Postal Service IBI specifications require a Facing Identification Mark (FIM) to be part of the IBI image so that the USPS Advanced Facer Canceller may detect the presence of an IBI mailpiece so as to sort the mailpiece properly. In the United States, the FIM is a pattern of vertical bars printed in the upper right portion of the mailpiece, to the left of the indicia. As currently specified, the United States Postal Service FIM is large, taking up approximately 20% of the proposed IBI image. A FIM uses a large amount of envelope space, which restricts the amount of information that can conveniently and neatly be presented in the IBI image. It would be desirable to eliminate the need for an FIM, such as through the use of fluorescence at the correct wavelength for reading by a facer-cancelor.

Security is a significant consideration for IBI indicia but machine-readable invisible ink has not been used for this purpose. Using current technology, invisible inks cannot be printed reliably without taking into account and adjusting for envelope material. Therefore, although 2-D bar codes are widely used to determine mail code authentication, useful 2-D bar codes are visible and can detract from the appearance of a mailpiece. Invisible inks have been available for a variety of uses and have been used in combinations with inks visible to the human eye, including for IBI images. Unfortunately, there are limitations as to current printing devices and inks, including invisible inks that can be used in ink jet printing devices. Low viscosity ink jet inks provide poor image resolution on porous paper, making the printing of a composite visible-invisible image problematic in an ordinary two cartridge ink jet printer having one black cartridge and one color cartridge with multiple, e.g., three, color nozzles. A three-nozzle, color cartridge cannot provide a dark enough image to meet IBI readability (machine reading) rates.

The need for high resolution has posed significant technical challenges, even with single-ink systems, due to paper and ink variations. Print quality for IBI images is essential, and in U.S. Pat. No. 5,871,288, Ryan, Jr., et al., describe a method for customer selectable module size for an information based indicia to assure quality for a 2-D bar code. Their method includes determining printer type, including print resolution, for printers that will print 2-D bar code and entering paper type for the envelope. Then, a suggested 2-D bar code module size is calculated based on the paper and the printer type. A test sample 2-D bar code is printed at the suggested 2-D bar code module size. The printed test sample is scanned and then evaluated for print quality and readability. They do not address the problem of controlling visual clutter on a mailpiece and are also not concerned with composite visible-invisible images. It would be desirable to avoid the need for customer setup and still assure an adequate read rate on all media while providing a large amount of printed information with little visual clutter. Current systems cannot provide a suitable combination of convenience, acceptable appearance and high readability.

Some recent systems employ a plurality of inks. For example, two recent patents, U.S. Pat. Nos. 6,270,213 and 6,142,380 to Sansone, et al., describe the use of dual luminescent inks to produce a postal orienting and sorting identification mark for information-based indicia (IBI) that does not require an FIM and is able to be read by Advanced Facer Canceller Systems. These patents describe printing layered images on the mailpiece. In particular, an upper layer IBI indicia is printed over a lower layer invisible ink. The lower layer ink is described as a "dual luminescent ink" that is invisible to the naked eye and the upper layer IBI indicia is printed with an ink that is visible to the naked eye. The lower layer may also be produced by two inks, one of which is fluorescent and the other of which is phosphorescent. The fluorescent ink is printed in one area of the lower layer and the phosphorescent inks is printed in another area of the lower layer. This does not address the problems solved by the invention which enables printing highly-reliable, high-density composite images using conventional ink jet printers.

Some prior art has utilized invisible inks and visible inks useful in certain contexts. For example, in U.S. Pat. No. 5,502,304, Berson, et al., describe a system that employs upper and lower bar codes. The lower layer bar code is written on an object with a normal ink and an upper layer bar code is written over the lower layer bar code with an ink that is invisible to the naked eye. A detector apparatus is described that is able to read the upper and lower level bar codes. And, in U.S. Pat. No. 5,525,798, Berson, et al., describe inks that are selectively excitable by different wavelengths of incident radiation. These inks allow a lower layer bar code to be written on an object with an invisible ink and an upper layer bar code to be written over the lower layer bar code with an ink that is invisible to the naked eye. The basic problems of the present invention, are not, however, addressed.

In U.S. Pat. No. 5,693,693, to Auslander, et al., wax-based invisible inks are described that emit light at various wavelengths in the visible region when they are excited by UV light. This allows lower layer clear text information to be written on an object with a regular, visible ink and an upper layer bar code to be written over the lower layer text information with an ink that is invisible to the naked eye. In this manner, more information can be provided than with conventional bar codes. In U.S. Pat. No. 5,684,069, to Auslander, an invisible ink is described that utilizes a substituted phthalocyanine dye in combination with selected waxes and resins. The ink is useful in thermal printing. It is transparent or almost transparent in white light, but is responsive to infrared light in the range of 720 to 1000 nm. The preferred waxes are polyethylene wax, natural paraffin wax and carnauba wax, and the preferred resin is ethyl vinyl acetate polymer. The patent refers to a prior process for providing security by printing authenticating text in invisible ink so that the same does not interfere with the document upon which such text is printed, but enables determining the authenticity and the holder of the document. An example is a scheme for placing a transparent label over a document with text printed on the label in invisible ink so that text covered by the label can be read. Again, the concerns of the invention are not addressed.

A number of other patents describe invisible inks and their use for postal and other applications without addressing the concerns of the invention described in this application.

U.S. Pat. No. 5,542,971, to Auslander, et al., describes inks that are selectively excitable by different wavelengths of incident radiation. This allows a lower layer bar code to be written on an object with an ink and an upper layer bar code to be written over the lower layer bar code with an ink that is invisible to the naked eye. In this manner, the lower layer and upper layer bar code can contain more information than conventional bar codes. The invisible inks used are based on complexes of rare earth elements with an atomic number higher than 57 such as: Eu, Gd, Tb, Sm, Dy, Lu with various chelating agents providing chromophore ligands that absorb in the ultraviolet and the blue region of the spectra such as: β-diketones, dipicolinic acid, etc.

In U.S. Pat. No. 5,837,042, Lent, et al., describe invisible fluorescent jet inks said to be suitable for producing security markings on documents and other articles. The jet ink compositions comprise a fluorescent colorant, an ink carrier, and optionally one or more binder resins. The markings are invisible to the unaided eye and are visible only when excited by ultraviolet light. The colorant comprises a rare earth metal and a chelating ligand, is excitable by ultraviolet light having a wavelength of from about 275 nm to about 400 nm, and fluoresces at a wavelength of from about 550 nm to about 700 nm, with the proviso that when the rare earth metal is europium, dysprosium, or terbium, the chelating ligand is not dibenzoylmethane. Also described is a method of identifying objects comprising providing a security marking as described above, exciting the marking and reading the fluorescent emission.

In U.S. Pat. No. 6,149,719, Houle describes light sensitive invisible ink compositions and methods for using them. The disclosed system generates high-definition, lightfast images that are easily read or otherwise detected using far red, infrared, and/or ultraviolet light. The inks contain an uncomplexed invisible metal phthalocyanine far red/infrared fluorophore (optimally chloroaluminum [III] phthalocyanine tetrasulfonic acid or salts thereof). An ultraviolet fluorophore can also be included. The inks are invisible to the unaided eye, but when exposed to far red or infrared light (wavelength=about 650–715 nm) they fluoresce at a wavelength of about 670–720 nm. When an ultraviolet fluorophore is employed, the inks can also be detected by applying ultraviolet light (wavelength=about 250–380 nm) which results in fluorescent emission at a wavelength of about 400–650 nm. The inks are said suited for forming invisible images using inkjet technology.

In U.S. Pat. No. 5,929,415, Berson describes a postage metering refill system that utilizes information contained in information based indicia to audit the franking process. Specifically, he provides a system that scans and reads IBI in accordance with the USPS Specification. The system addresses both the readability and security of the IBI. The apparatus utilizes a postage meter that prints an IBI, scans and checks the IBI and prints an invisible, secure message, i.e., bar code, over the IBI. When, the mailpiece arrives at the post, the additional material is scanned and read at the same time the IBI information is scanned and read. The scanned verification information is then collected and may be subsequently transmitted to a central data center and used for further verification of the postage paid. This stored information may be retrieved during connection to a central postage meter resetting data center when the meter is reloaded and forensically checked.

In U.S. Pat. No. 6,039,257, Berson, et al., describe a system that utilizes a postage meter that prints an Information-Based Indicia, scans and checks the Information-Based Indicia and prints an invisible, secure message, i.e., bar code over the Information-Based Indicia.

There remains a need for a system that can produce machine-readable IBI images containing both 2-D bar code information and address and postage information that are printed to provide increased read rates and the provision of high information density without obscuring any one component. It would be desirable in this context to print an IBI image that would include redundant information within the IBI image or between the IBI and a visible dark image. It would be especially desirable to have such a system wherein the images are printed using conventional ink jet printers using water-based inks.

SUMMARY OF THE INVENTION

It is an object of the invention to provide a method for printing postal and other information with a high information density in a highly reliable and visually pleasing form.

It is another object of the invention to provide a method for printing composite images that can contain large amounts of information, including redundant information, in an eye-pleasing format.

It is another object of the invention to provide a method for printing composite images containing largely invisible, machine-readable postage-evidencing symbology and dark, visible images containing address and postage information.

It is another object of the invention to provide a method meeting one or more of the above objects that can be carried out utilizing a conventional two-cartridge, color ink jet printer.

It is another object of the invention to eliminate the need for an FIM by printing a postage-evidencing symbology module in a light-colored or invisible ink having the correct wavelength for a facer-cancelor.

It is another object of the invention to avoid the need for customer setup and still assure an adequate read rate for postage-evidencing symbology independent of envelope material.

It is another object of the invention to provide a desirable combination of convenience, acceptable appearance and high readability for postage-evidencing symbology and other images.

It is yet another object of the invention to provide a system that can produce machine-readable postage-evidencing symbology containing both 2-D bar code information and address information, printed in a single pass through a printer having a visible dark image and light-colored or invisible, but luminescent, postage-evidencing symbology in large-format to provide increased read rates and the provision of high information density without obscuring any one component.

It is a still further object of the invention to provide, in this context, a system to print large-format IBI images that can include error correction information within the IBI image or between the IBI and visible dark image.

It is another object of the invention to provide systems of the type mentioned wherein the images are printed using water-based inks in conventional ink jet printers.

These and other objects are accomplished by the invention, which provides improvements for printing machine-readable postage-evidencing symbology and visible address information on a mailpiece.

The method of the invention comprises: printing a visible dark image including visible (human-readable) address information; and printing a light-colored or invisible, luminescent, postage-evidencing symbology at a predetermined size that is readable independent of envelope material.

An apparatus is also provide by the invention and comprises: a single-pass print stage capable of printing an IBI image in either a visible dark ink or a light-colored or invisible ink; a multiple-pass print stage capable of printing dark image including human-readable address and postage information; and control means engaged with the single-pass print stage and the multiple-pass print stage to control printing of an IBI image at the single-pass print stage and a dark image including human-readable address and postage information at the multiple-pass print stage.

The method has a number of preferred aspects, many of which are described below and shown in the accompanying drawings.

BRIEF DESCRIPTION OF THE DRAWING

The invention will be better understood and its advantages will become more apparent from the following description, especially when read in light of the accompanying drawing, wherein.

DETAILED DESCRIPTION OF THE INVENTION

Figure 1:
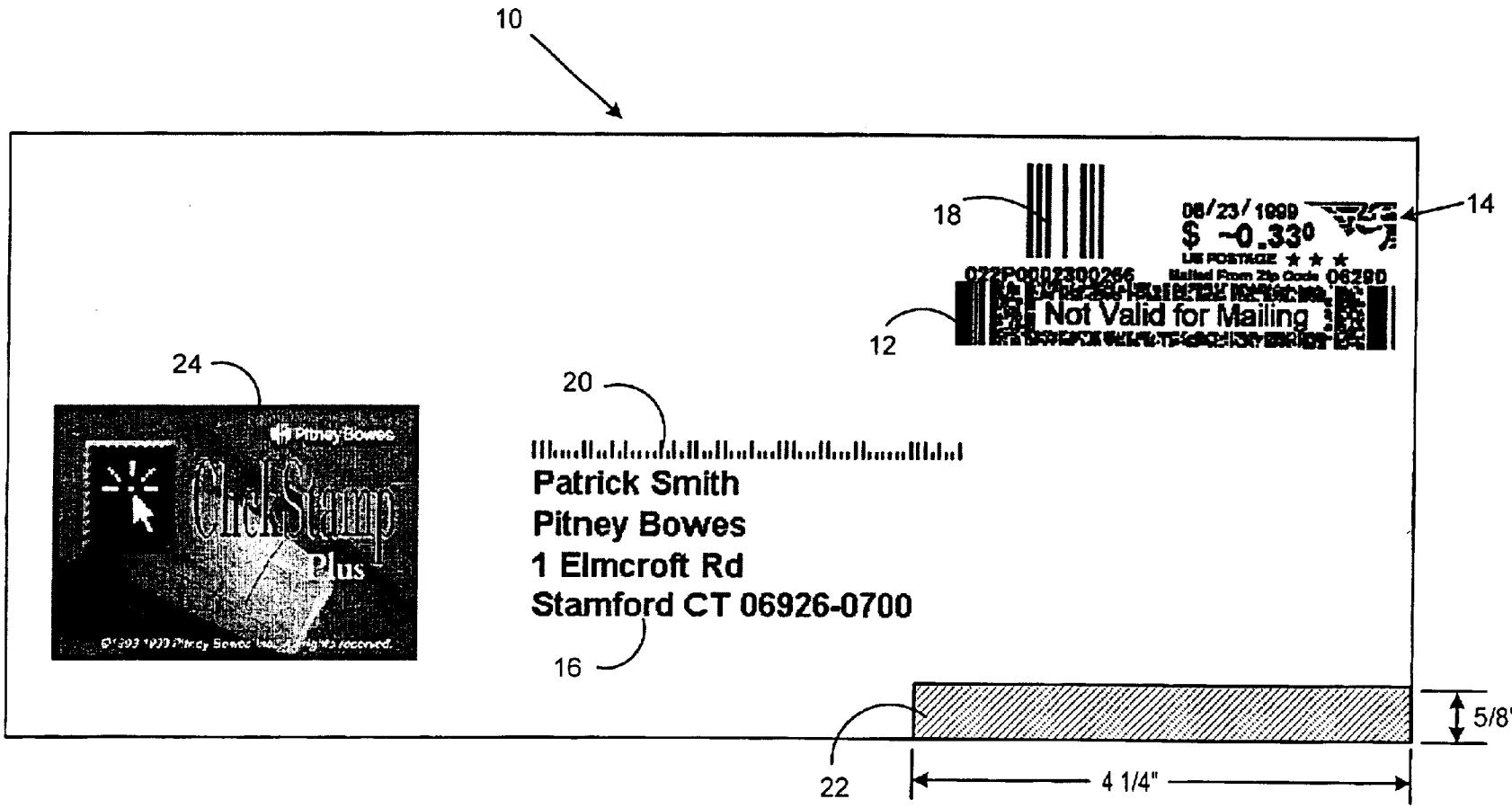
FIG. 1 is a schematic drawing illustrating a prior art conventional layout for a mailpiece printed in accord with IBIP Specifications.
Figure 2:
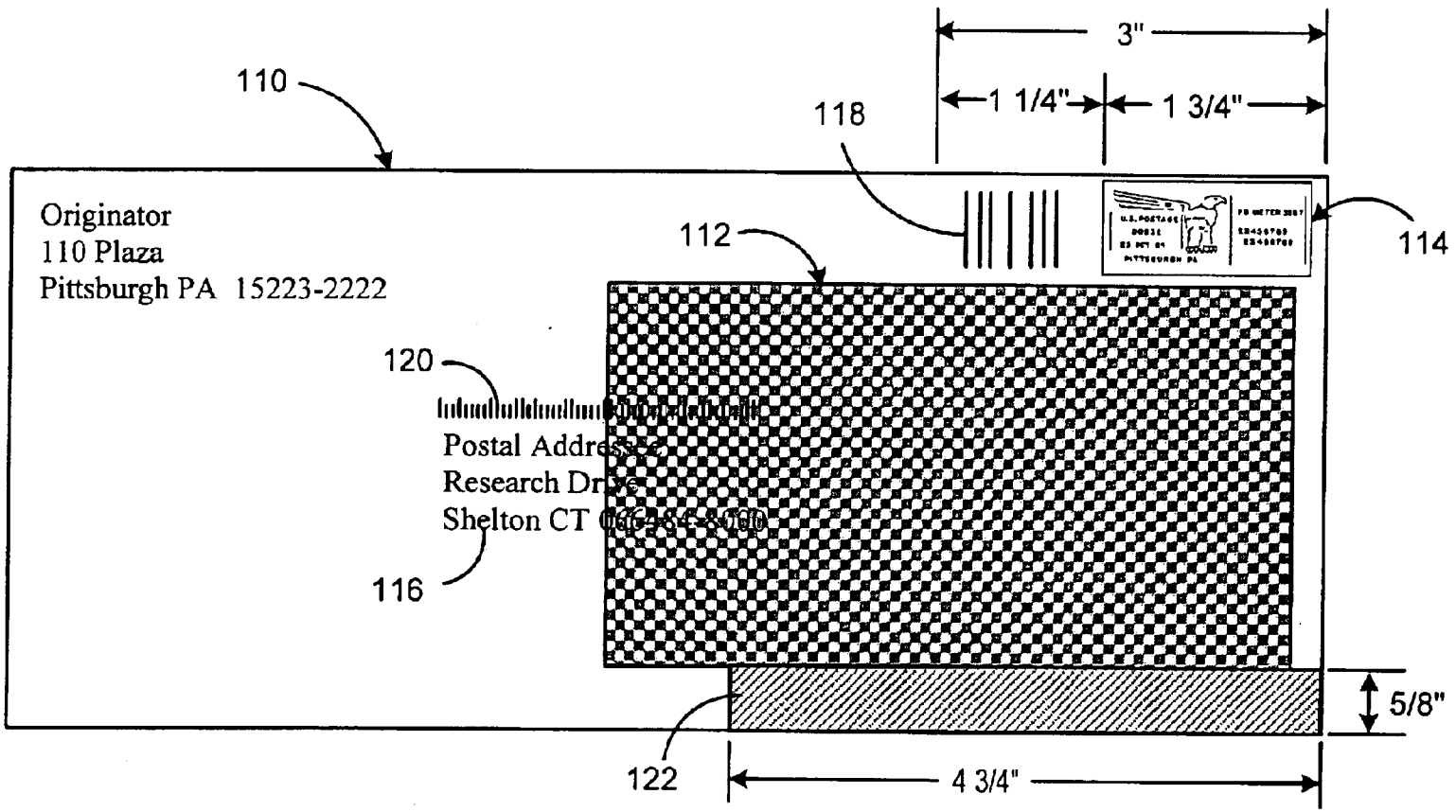
FIG. 2 is a schematic drawing illustrating a layout for a mailpiece printed in accord with the invention.

The invention relates to printing composite images that can contain large amounts of information on mailpieces, such as mailpiece 10 illustrated in FIG. 2. The composite images, as will be explained in detail below, can optionally include redundant information, over and above that on the envelope of FIG. 1, which is printed using conventional formatting. In FIG. 1, there is a distinct concession made in terms of readability and area printed to achieve a visually acceptable envelope having imaging of suitable readability.

FIG. 1 illustrates a typical prior art format wherein postage-evidencing information 12 is printed as a module, here an IBI image, along with visible postage image 14 and information in an address block 16. In preferred forms, the IBI image is printed to include error correction information, which can be redundant with information internally within itself and/or with information in the visible image. The address block 16 of a mailpiece is the primary source of address information and contains a human-readable address and preferably includes a Delivery Point Bar Code (DPBC), illustrated as 20. To maintain readability of all elements, the postage-evidencing information 12 cannot overlap with information in the address block 16 and or a barcode clear zone 22 when the piece bears a DPBC 20 in the address block 16. The FIM 18, which is required for facing by a facer-canceller, can be printed.

A DPBC 20 is formed by adding 10 bars (representing two additional digits) to a standard ZIP+4 code. The ZIP+4 code is a single field of 52 bars consisting of a frame bar, a series of 25 bars that represent the correction digit, and a final frame bar. The DPBC 20 or other POSTNET (POSTal Numeric Encoding Technique) bar code can be printed just about anywhere on the address side of the mailpiece that is at least ⅛th inch from any edge. Typically and preferably, it is printed in the upper portion of the address above the recipients name as shown in FIG. 1. Each letter-size piece in an automation rate mailing and each piece of upgradeable Presorted First-Class Mail or upgradeable Standard Mail, must have a barcode clear zone 22 unless the piece bears a DPBC in the address block. If desired, an additional advertising or other block 24 can be added outside of the other information fields. The net effect of providing large amounts of useful and optional information in this standard format can be a visually unattractive mailpiece.

The invention provides an envelope that can be more visually acceptable than standard, preferably while providing more information. Indeed, the invention enables adding complexity to the image to provide a large amount of information, while enabling printing in an eye-pleasing format. Moreover, mailpieces can advantageously be printed using conventional ink jet printers, e.g., of the type used to print color images from personal computers. The composite images of the invention provide high information density in a highly reliable and visually pleasing form and offer significant security features.

Alternative franking locations are being considered by some Postal Services. One example of an alternative franking location is printing the 2-D barcode in the address block. Using the address block as the location for the 2-D barcode allows the 2-D barcode to be printed on a document inserted in a windowed envelope, with the 2-D barcode and addressee text showing through the window of the envelope. The present invention is suitable for such alternative franking locations, whether the 2-D barcode is printed on the document inserted in the windowed envelope or printed directly on the envelope. The present invention is also suitable for use with documents known in the industry as self mailer documents, i.e., a document that can be mailed without being enclosed in an envelope. Such documents typically are prepared using a self-mailer device that accepts paper stock, applies glue, and then folds and perforates the paper to form a mailable document.

Figure 3:
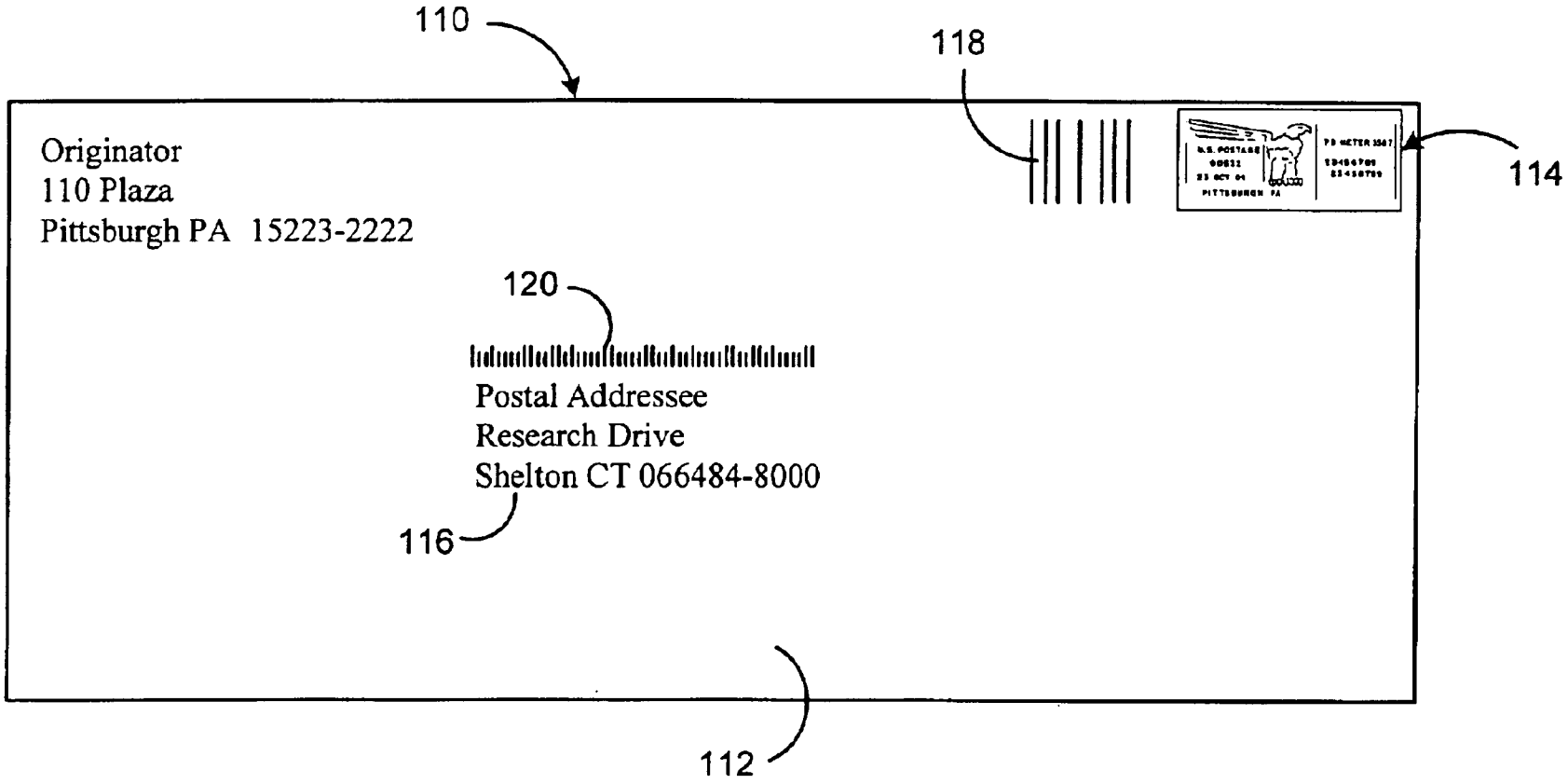
FIG. 3 is a drawing of the mailpiece of FIG. 2, but showing only the visible images.

FIG. 2 illustrates the improvements of the invention by showing an arrangement of a composite image comprised of visible and invisible image components wherein elements similar to those shown in FIG. 1 are identified by three digit numbers starting with 1 followed by the corresponding two digit number used in FIG. 1. FIG. 3 shows the envelope of FIG. 2, but with only the visible elements shown. The result is clearly an improvement. Note that the postage-evidencing symbology 112 is invisible. The composite images of the invention comprise a novel arrangement of an unobtrusive machine-readable postage-evidencing symbology, e.g., an Information Based Indicia (IBI) image, in large format, e.g., 112 in FIG. 2, which can contain 2-D bar code information, and a dark, visible image 114 containing postage information, which can be printed separately or with the address information 116 and an optional FIM 118. It is an advantage of the invention that the need for FIM 118 may be eliminated by using an invisible ink having the correct wavelength for a facer-cancelor and that the need for customer setup of the type required by U.S. Pat. No. 5,871,288 is eliminated while an adequate read rate for IBI images independent of media is assured.

While the invention has broader utility, this description will detail preferred forms wherein a conventional multi-cartridge, color ink jet printer is utilized to print the images in the described image format. It will be recognized, however, that specialized printers devised to include the features of the invention alone or with other functionality can be employed. The preferred printers for use in the process of the invention will be of the type having a single-color cartridge, usually intended for printing black images, and a multi-color (e.g., three-color) cartridge typically used for printing colored inks and capable of printing dark composite images. It is an advantage of one preferred embodiment that, while a three-color cartridge is not generally capable of printing a reliable IBI image due to lack of edge definition, the single-color cartridge can be replaced with a cartridge containing a light-colored or invisible, luminescent, ink for printing postage-evidencing symbology, e.g., an IBI image, in large-format. The IBI image can contain a machine-readable 2-D bar code. The visible postage and optional address information can be printed with adequate definition as a three-color composite dark image from a standard multi-color cartridge of a conventional color ink jet printer, such as any of the Cannon Bubble Jet®, Hewlett Packard DeskJet®, IBM® or Xerox® ink jet color printers. As used herein, light-colored, luminescent ink means any visible ink with the specified luminescent properties that is light in color such that when printed over human readable information does not prevent the human readable information from being read.

As noted, the address block of a letter is the primary source of address information and contains a human-readable address and preferably includes a Delivery Point Bar Code (DPBC), illustrated as 120 in FIG. 2. Typically and preferably, it is printed in the upper portion of the address above the recipients name as shown in FIG. 2. A barcode clear zone is illustrated as 122 in FIG. 2. Standard dimensions for the various areas of printed information are indicated.

With these as principal constraints, a postage-evidencing symbology block can be printed in a size that is readable independent of envelope material. The size of the postage-evidencing symbology module will be predetermined, e.g., of large-format IBI as image 112, to be machine readable independent of substrate material, yet be of high complexity containing large amounts of information. It is an advantage of the invention that it enables provision of a large amount of information in an eye-pleasing format by printing it in a largely or wholly invisible ink (either of light color or invisible to the eye when dry). As used herein, the term "large-format IBI image" means an IBI image that is printed in a module size of greater than 15 mils, and preferably greater than 18 mils, e.g., within the range of from 16 to 25 mils or larger. These module sizes are defined in PCIBI-O, dated 2000.

The composite images of the invention comprise a novel arrangement of a largely-invisible machine-readable postage-evidencing symbology block in large format and a dark, visible image containing postage information, and optionally address and FIM images. The size of the postage-evidencing symbology block is determined for readability and it is an advantage of the invention that it can be printed without concern for overwriting human readable information. Indeed, it can be specifically selected to overlap at least a portion of the human readable postage information. In a preferred format according to the invention, the postage-evidencing symbology block 112 is the predominant image, preferably covering an area at least 50%, e.g., up to about 200%, larger than the visible postage image 14. From another perspective, the postage-evidencing symbology block can comprise a major portion of the face of an envelope or other mailpiece. Indeed, it can cover up to approximately the entire face of an envelope. In preferred forms, the largely invisible postage-evidencing symbology block is printed to include information redundant with information internally within itself and/or with information in the visible image. Where necessary or desirable, a large-format image 112 can overlap with information in the address block 116 and in the barcode clear zone 122 when the piece bears a DPBC 20 in the address block 116.

It is a distinct advantage of the invention that the composite images can optionally include redundant information to provide more "resiliency" to envelope damage. It can, by providing error correction coding, permit maintenance of high read rates despite damage to otherwise critical information. Thus, if a potion of the information in the machine-readable postage-evidencing symbology block becomes obscured due to poor printing or handling, the image can have redundant information available elsewhere in the image.

The dark visible image portion 114 can be printed with a composite color image from a standard multi-color (e.g., three color) ink jet cartridge, unlike an IBI or other postage-evidencing symbology block, which cannot be printed with adequate resolution in this manner. These cartridges are well known and commercially available—another clear advantage of the invention.

The largely invisible image will be printed with an ink effective for machine reading. These inks are typically of the type that are luminescent, and can be either fluorescent or phosphorescent, as those terms are commonly understood and well explained in the patents discussed above. Among the suitable inks are ones similar to the inks exemplified below and those defined in the above patents describing invisible formulations.

It is an advantage of the invention that the process can employ a commercial ink-jet color printer to print the composite image of the invention in a single print operation. By the term "single print operation" it is meant that the mailpiece is fed as normal for the printer and moved as necessary between multiple print heads to print a composite image before being ejected. The printer can include, as desired, suitable software and/or optional hardware modifications to achieve the objectives of the invention, by printing an invisible or lightly colored postage-evidencing symbology block on a mailpiece along with visible, human readable information such as postage and address information. It is an advantage of the invention that no changes may be needed for a conventional ink jet printer to achieve the advantages of the invention. An apparatus modified for the invention can comprise a single-pass print stage capable of printing in a light-colored or invisible ink; a multiple-pass print stage capable of printing a dark image including human-readable information; and control means engaged with the single-pass print stage and the multiple-pass print stage to control printing of an IBI image at the single-pass print stage and a dark image including human-readable address and postage information at the multiple-pass print stage. The single-pass print stage will comprise the means normally used to print images in black ink, and the multiple-pass print stage will comprise the means normally used to print color images.

Figure 4:
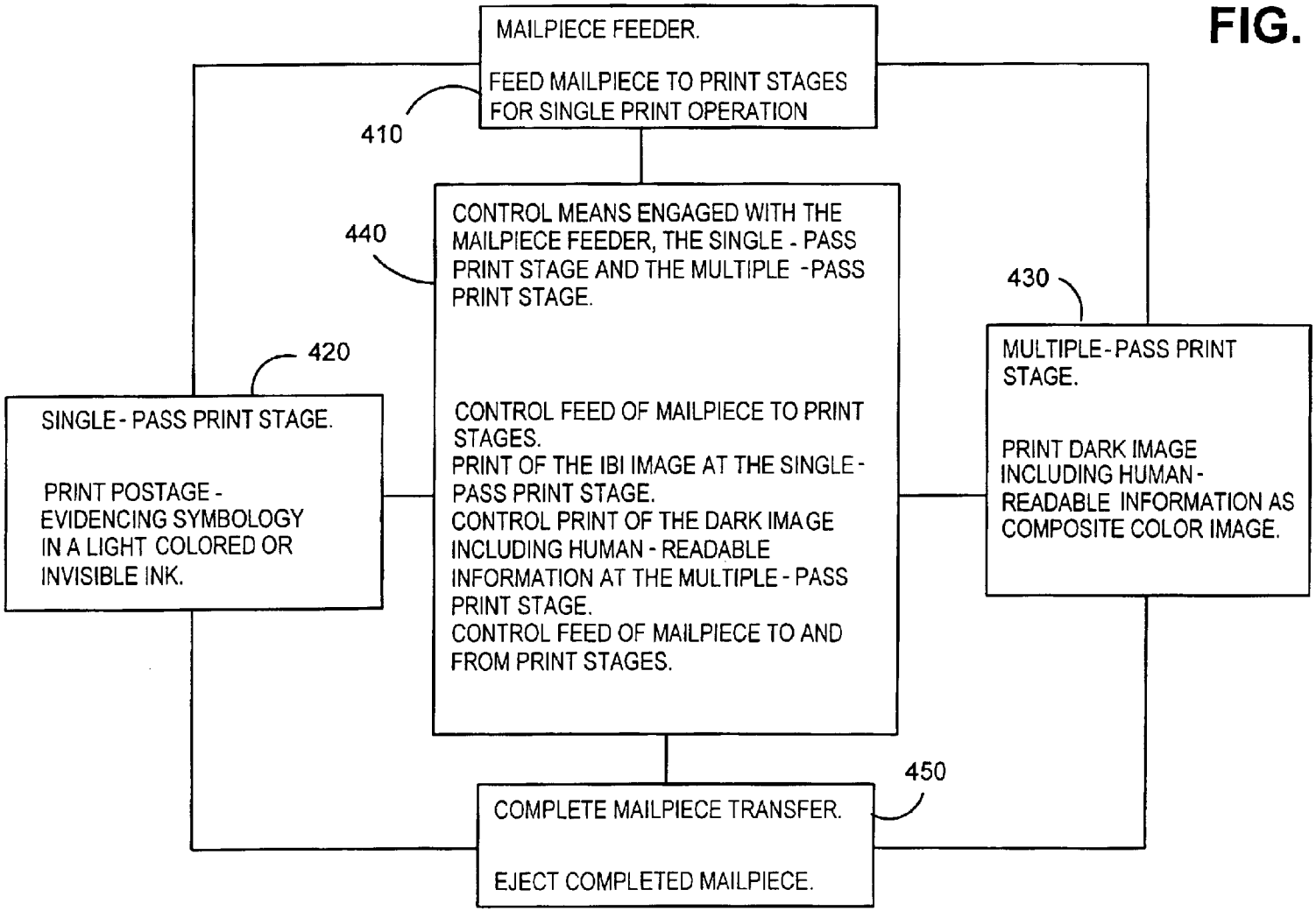
FIG. 4 is a flow diagram illustrating a process sequence for forming a composite image according to the invention.

Reference to FIG. 4 illustrates the elements of this apparatus and includes a mailpiece feeder, a single pass print stage, a multiple pass print stage, and control means engaged with the mailpiece feeder, the single-pass print stage and the multiple-pass print stage. Means are also provided either as part of the mailpiece feeder or separately to complete mailpiece transfer by ejecting the completed mailpiece. As part of the printing process, a unique FIM, which is effective to direct facer/canceller equipment to shine activating radiation onto the mailpiece to read the IBI image, can be printed on the mailpiece. The use of such an FIM can instruct the facer/cancelor machine to treat the mailpiece according to a predetermined protocol.

The Mailpiece feeder can be any means suitable for feeding a mailpiece to and between the print stages. It can comprise any of the various means known in the art for inkjet printers, including elastomeric rollers or conveyor belts operated by one or more servomotors and suitable controllers. The control software can be partially or wholly contained within the apparatus and can be partially maintained within an external computer-driven control, such as a personal computer programmed to print postage.

The system will also include a single-pass print stage to print a postage-evidencing symbology block in a largely invisible, i.e., light-colored or invisible, ink. Current regulations require this image to have a degree of resolution necessary to provide read rates in excess of 99.5%. Suitable for this print stage is the stage of a conventional inkjet printer used for printing black ink. The multiple-pass print stage of the system of the invention will preferably be of the type capable of printing dark images including human-readable postage information. Because a key feature of the invention is the ability to utilize conventional color inkjet printers, the multiple-pass print stage of the system of the invention will preferably comprise the multiple-pass print stage usually provided for printing color images. This stage is capable of printing dark, even black, composite images in a manner fully within the capabilities of such standard systems by application of suitable inks, for example, by usually three independent ink nozzles for a composite dark color.

To most effectively achieve the composite image format of the invention in single print operation, the system of apparatus of the invention can include control means engaged with the mailpiece feeder, the single-pass print stage and the multiple-pass print stage. The control means can control feeding of individual mailpieces to the print stages, printing the IBI image at the single-pass print stage, printing the dark image including human-readable postage information at the multiple-pass print stage, and feeding the mailpieces to and from print stages. If desired, a separate means can be employed to complete mailpiece transfer and eject completed mailpieces under the control of the controller.

It is an advantage of another aspect of the invention in connection with the ability to utilize conventional color inkjet printers, that the provision of a simple control mechanism can simply switch operation from the printer's normal mode to the mode of the invention. In one simple form the apparatus can include a postage-dedicated print cartridge having a lightly colored or invisible, but machine-readable ink as described above. Preferably, switch means are provided to enable replacing the single-pass black ink cartridge with a cartridge holding invisible or nearly invisible ink. The switch means will preferably be operable responsive to a signal representing the presence or absence of a postage-dedicated print cartridge. The switch means can be associated with the cartridge holder in the printer such that the cartridge is recognized when the invisible ink cartridge is inserted or it can be a manual switch or part of the software of the computer driving the printer. The presence of a postage-dedicated print cartridge can be done visually, electronically or by mechanical switch or sensing means. Preferably, the switch means will be associated with control software to provide an error message if a postal printing program is not in use and will prevent the use of the postal printing features unless the proper cartridge is in place.

It is another advantage of the invention that, when appropriate, the largely invisible ink need not be used for the IBI image. This may occur when the IBI image can be printed in a format that does not unduly clutter the appearance of the mailpiece. Again, the controller for the printer, either internally or as part of the driving computer software, can have program options permitting this choice.

The following Examples are provided to further illustrate and explain preferred invisible ink forms useful in the practice of the invention and are not to be taken as limiting in any regard. Unless otherwise indicated, all parts and percentages are by weight.

EXAMPLE 1

This example illustrates an invisible red fluorescent ink formulated by using a water-soluble organic fluorescent pigment from Riedel de Haen and NF1076 Neat. The pigment is very readily soluble in aqueous systems (860 g/L) and dissolves very rapidly. The formulation of the ink is as follows:

1.10% Lumilux Red CD 380

1.98% PVP (Kollidone K-12)

6.28% BTG 9.9% 2-Pyrrolidone 24.64% Polyethylene Glycol (M.W. 200)

56.10% Distilled H20

The ingredients are mixed to achieve homogeneity.

The ink exhibits the following properties:

Viscosity=4.1 cp

Surface Tension=40.3 dynes/cm

EXAMPLE 2

This example illustrates formulation of a low-viscosity invisible red fluorescent ink following the procedure of Example 1 from the following components:

1.10% Lumilux Red CD 380

1.60% PVP (Kollidone K-12)

6.00% BTG 6.00% 2-Pyrrolidone 8.00% Polyethylene Glycol (M.W. 200)

77.3% Distilled H20

The ink exhibits the following properties:

Viscosity=2.2 cp

Surface Tension=39.0 dynes/cm

In an alternate embodiment, the present invention includes the use of composite ink in the address block to provide a more information-rich bar code that would be invisible. Examples of a more information-rich bar code are barcodes that are longer or denser, printing multiple planet codes (such as one for the postal service and one for the mailer). The USPS already reads POSTNET and PLANET™ Code barcodes in the address block. The present invention provides for more information printed on the mailpiece, including in the address block, even for mailers who are not using a postage meter to evidence postage payment. Mailers can print a mailpiece or shipping label with an information richness equivalent to IBI in the indicia.

A PLANET™ Code barcode is a 12 or 14 digit barcode where the first two digits represent the service you want, the next nine digits identify the mail piece and the last digit is a check-sum digit that helps USPS detect errors. The PLANET™ Code barcode is the inverse of the POSTNET barcode. For more information about PLANET Codes refer to the Web site www.planetcodes.com. A POSTNET (Postal Numeric Encoding Technique) barcode system is used on letter-size and flat-size mailpieces for encoding the delivery point information and ZIP+4 code information. A delivery point barcode (DPBC) is a POSTNET barcode that consists of 62 bars with beginning and ending frame bars and 5 bars each for the nine digits of the ZIP+4 code, the last 2 digits of the primary street address number (or post office box, etc.), and a correction digit. The DPBC allows automated sortation of letter mail to the carrier level in walk sequence.

In accordance with this embodiment, non-postage evidencing mailpiece identification information can be printed on the mailpiece using invisible ink. For example, the present invention may be used for printing the recipient address block and sender address block using the visible ink and printing PLANET™ Code barcodes in invisible ink on the mailpiece whereby postal authority does PLANET™ code processing.

This alternate embodiment eliminates cluttering of mailpiece with information used by the postal authority and the mailer but is of no interest to the recipient but is of use to the mailer, for example, to entitle the mailer to receive postal discounts. This invention allows for the mailer to include more information on the mailpiece without having a negative effect on the aesthetics of the mailpiece to the recipient.

In a further embodiment of the present invention, information is printed on a business reply envelope in invisible ink. Upon receiving the business reply envelope, the mailer can obtain information directly from the envelope, for example, determining the particular mailing to which the customer is responding. Thus, the mailer uses information that mailer printed on a returned mailpiece, for example, to track promotional codes or mailing codes.

Figure 5:
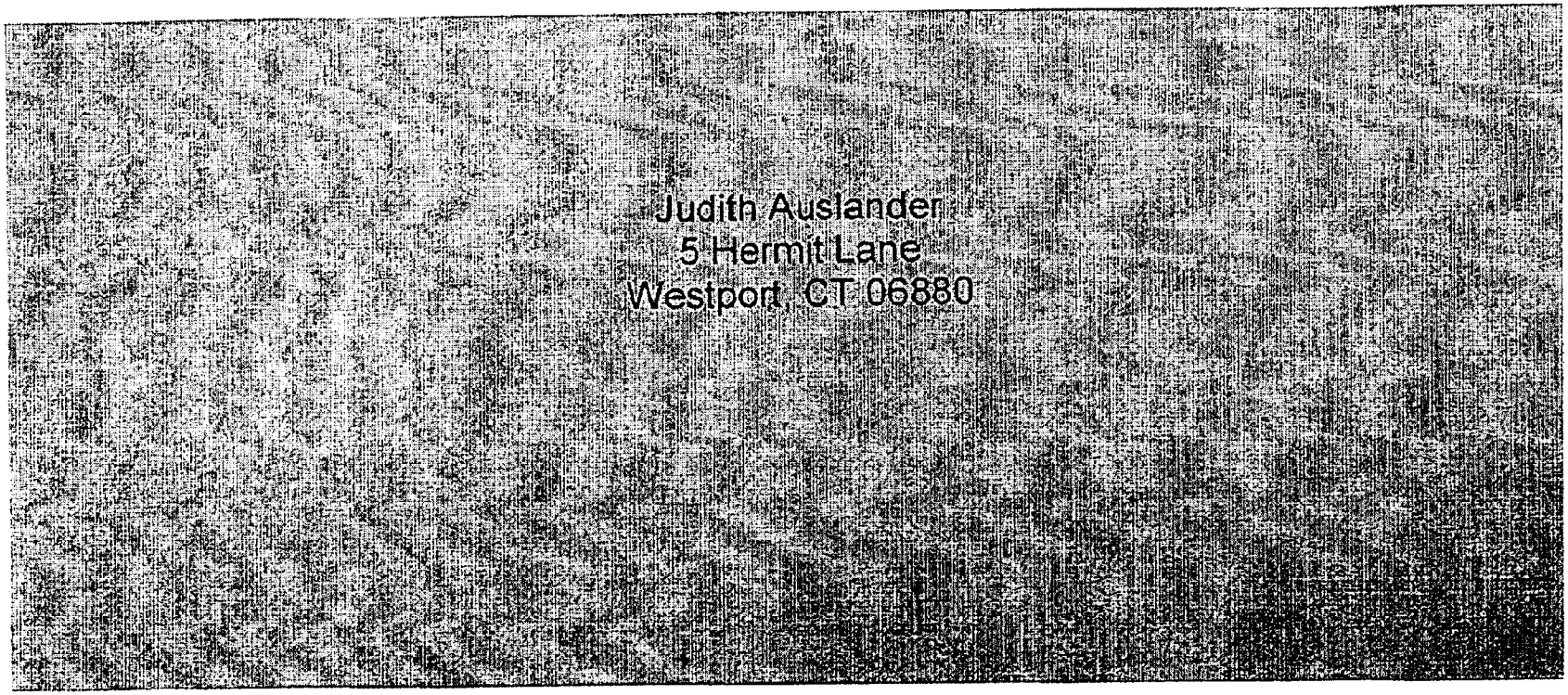
FIG. 5 is a drawing of an information enriched mailpiece printed in accord with the invention.

Referring now to FIG. 5, an information enriched mailpiece is shown with the recipient address printed in visible ink and the PLANET™ Code and POSTNET barcodes and a 2-d bar code printed in invisible ink. The human readable recipient address image is visible under ambient light. The machine-readable barcodes are visible under UV light excitation.

Figure 6:
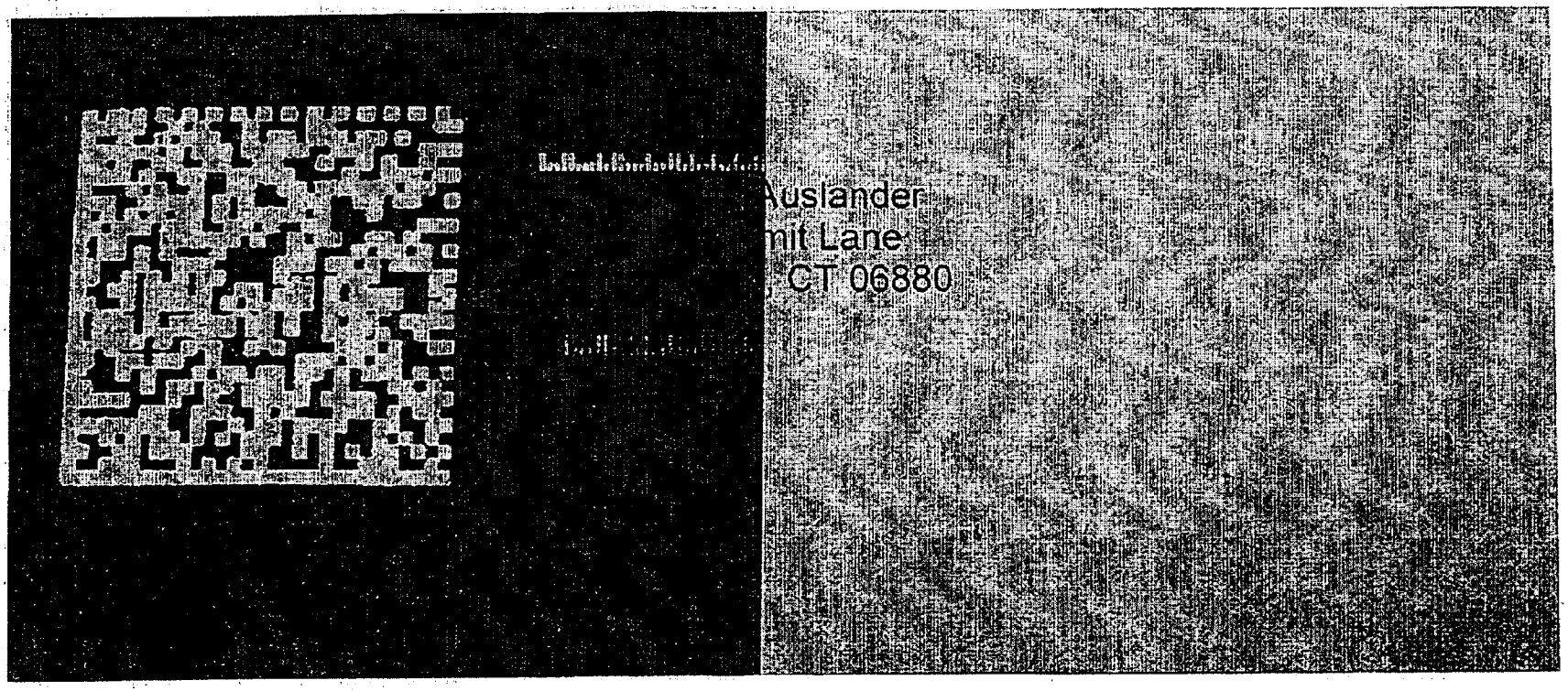
FIG. 6 is a drawing of the mailpiece of FIG. 5 of FIG. 4 but shown in ambient light on one side and UV light on the other side.

Referring now to FIG. 6 is a drawing of the mailpiece of FIG. 5 of FIG. 4 but shown in ambient light on the right side and UV light on the left side.

Figure 7:
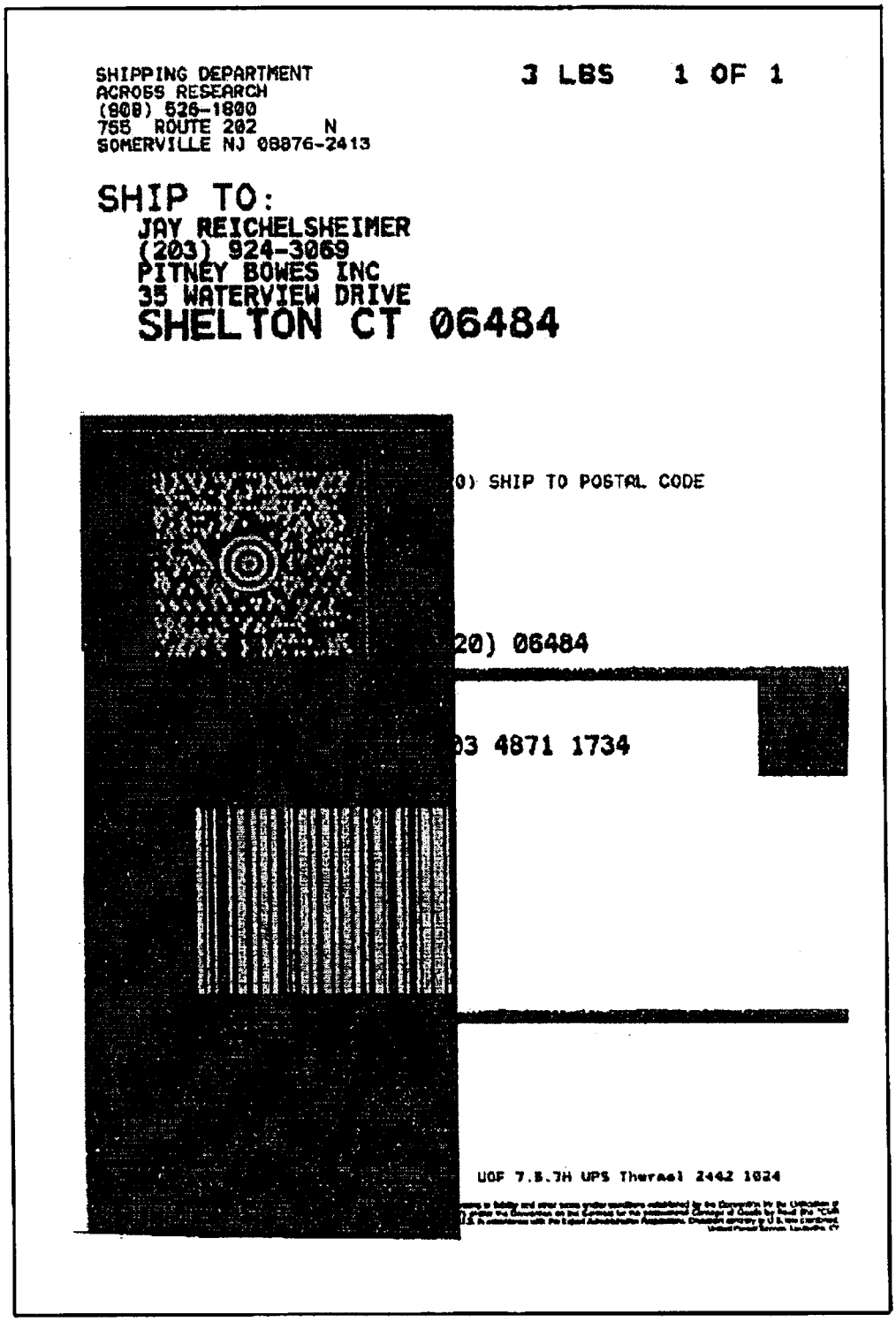
FIG. 7 is a drawing of an information enriched shipping label printed in accord with the invention.

FIG. 7 is a drawing of an information enriched shipping label printed in accord with the invention. The human readable recipient address image is visible under ambient light. The machine-readable barcodes are visible under UV light excitation.

The preferred embodiment of the present invention is described herein for use in printing authentication bar codes on mailpieces. It will be understood that the invention can also be used to print information, such as authentication information, or bar codes, on other documents, including but not limited to legal or financial documents.

The above description is intended to enable the person skilled in the art to practice the invention. It is not intended to detail all of the possible modifications and variations, which will become apparent to the skilled worker upon reading the description. It is intended, however, that all such modifications and variations be included within the scope of the invention, which is seen in the above description and otherwise defined by the following claims. The claims are meant to cover the indicated elements and steps in any arrangement or sequence, which is effective to meet the objectives, intended for the invention, unless the context specifically indicates the contrary.

What is claimed is:

1. A method for desktop printing information on a mailpiece, the method comprising the steps of:

printing in a single print operation human-readable information with the visible ink and machine-readable information with invisible luminescent ink, wherein an image of the machine-readable information is printed at a predetermined size that is readable independent of envelope material, wherein the machine-readable information image is printed in a module size of greater than 15 mils.

2. A method for desktop printing information on a mailpiece, the method comprising the steps of:

printing in a single print operation human-readable information with the visible ink and machine-readable information with invisible luminescent ink, wherein an image of the machine-readable information is printed at a predetermined size that is readable independent of envelope material, wherein the machine-readable information image is printed with a degree of resolution necessary to provide read rates in excess of 99.5%.

3. A method for desktop printing information on a mailpiece, the method comprising the steps of:

printing in a single print operation human-readable information with the visible ink and machine-readable information with invisible luminescent ink, wherein an image of the machine-readable information is printed at a predetermined size that is readable independent of envelope material, wherein the machine-readable information is postage evidencing symbology and wherein the postage evidencing symbology is an IBI image including information redundant with the human-readable image.

4. A method for desktop printing information on a mailpiece, the method comprising the steps of:

printing in a single print operation human-readable information with the visible ink and machine-readable information with invisible luminescent ink, wherein an image of the machine-readable information is printed at a predetermined size that is readable independent of envelope material, wherein the machine-readable information is postage evidencing symbology, and including in one of the printing steps, the printing of a unique FIM effective to direct facer/canceller equipment to shine activating radiation onto the mailpiece to read the machine-readable image.

5. A method for printing postage evidencing symbology module and postage information on a mailpiece, comprising:

printing on the mailpiece a visible dark image including human-readable information; and printing on the mailpiece a invisible, luminescent, postage evidencing symbology module in a predetermined size with a degree of resolution necessary to provide read rates in excess of 99.5%, the image being printed in large-format in a module size of greater than 15 mils and containing a machine-readable 2-D bar code;

wherein the images are printed with water-based ink jet inks in a conventional ink jet printer by printing the postage evidencing symbology module with a single-color ink and printing the visible dark image as a composite dark color from a multi-color cartridge.

6. A method for printing according to claim 5, wherein an IBI image is printed with a water-based ink including a visually-colorless ink comprising a rare earth element with an atomic number higher than 57.

7. An apparatus for machine-readable images on a mailpiece containing human readable postage information and postage evidencing symbology, comprising:

a single-pass print stage capable of printing a machine-readable image in an invisible ink;

a multiple-pass print stage capable of printing dark image including human-readable address and postage information; and control means engaged with the single-pass print stage and the multiple-pass print stage to control printing of an IBI image at the single-pass print stage and a dark image including human-readable address and postage information at the multiple-pass print stage.

8. An apparatus according to claim 7, which further includes switch means operable responsive to a signal representing the presence or absence of a postage-dedicated print cartridge.

9. An apparatus according to claim 7, wherein the postage evidencing symbology images are printed from a single-color ink cartridge and the human-readable information images are printed from a multi-color cartridge.

10. An apparatus according to claim 7, wherein the inks are water-based jet inks.

11. An apparatus according to claim 7, wherein in one of the printing steps, the printing of an FIM effective to direct facer/canceller equipment to shine activating radiation onto the mailpiece to read the IBI image.

12. An apparatus according to claim 7, wherein an invisible image is printed with a degree of resolution necessary to provide read rates in excess of 99.5%.

13. An apparatus according to claim 7, wherein the machine-readable image is printed in a module size of greater than 15 mils.

14. An apparatus according to claim 7, wherein a machine-readable image is printed with a water-based ink including a visually-colorless ink comprising a rare earth element with an atomic number higher than 57.

15. A method for desktop printing information on a mailpiece, the method comprising the steps of:

printing in a single print operation human-readable information with the visible ink and machine-readable information with light-colored luminescent ink, wherein an image of the machine-readable information is printed at a predetermined size that is readable independent of envelope material, wherein an invisible image is printed with a degree of resolution necessary to provide read rates in excess of 99.5%.

16. A method for desktop printing information on a mailpiece, the method comprising the steps of:

printing in a single print operation human-readable information with the visible ink and machine-readable information with light-colored luminescent ink, wherein an image of the machine-readable information is printed at a predetermined size that is readable independent of envelope material, wherein the machine-readable information image is printed in a module size of greater than 15 mils.

17. A method for desktop printing information on a mailpiece, the method comprising the steps of:

printing in a single print operation human-readable information with the visible ink and machine-readable information with light-colored luminescent ink, wherein an image of the machine-readable information is printed at a predetermined size that is readable independent of envelope material, wherein the machine-readable information image information is postage evidencing symbology and wherein the postage evidencing symbology is an IBI image including information redundant with the human-readable image.

18. A method for desktop printing information on a mailpiece, the method comprising the steps of:

printing in a single print operation human-readable information with the visible ink and machine-readable information with light-colored luminescent ink, wherein an image of the machine-readable information is printed at a predetermined size that is readable independent of envelope material, wherein the machine-readable information image information is postage evidencing symbology, and including in one of the printing steps, the printing of a unique FIM effective to direct facer/canceller equipment to shine activating radiation onto the mailpiece to read the machine-readable image.

19. A computer readable medium for providing program code for execution by a programmable data processor, said processor being responsive to said program code to control a printer to:

print in a single print operation human-readable information with the visible ink and machine-readable information with luminescent ink, wherein an image of the machine-readable information is printed at a predetermined size that is readable independent of envelope material, wherein the machine-readable information image is printed in a module size of greater than 15 mils.

20. A computer readable medium for providing program code for execution by a programmable data processor, said processor being responsive to said program code to control a printer to:

print in a single print operation human-readable information with the visible ink and machine-readable information with luminescent ink, wherein an image of the machine-readable information is printed at a predetermined size that is readable independent of envelope material, wherein the machine-readable information is postage evidencing symbology and wherein, the postage evidencing symbology is an IBI image including information redundant with the human-readable image.

* * * * *